US012344992B2

(12) United States Patent
Santanocito et al.

(10) Patent No.: US 12,344,992 B2
(45) Date of Patent: Jul. 1, 2025

(54) SYNTHETIC LEATHER OF VEGETABLE ORIGIN

(71) Applicant: OHOSKIN S.R.L. [IT/IT], Catania (IT)

(72) Inventors: Adriana Santanocito, Viale Vittorio (IT); Roberto Merighi, Fratta Polesine (IT)

(73) Assignee: OHOSKIN s.r.l. [IT/IT], Catania (IT)

( * ) Notice: Subject to any disclaimer, the term of this patent is extended or adjusted under 35 U.S.C. 154(b) by 638 days.

(21) Appl. No.: 17/756,269

(22) PCT Filed: Nov. 20, 2020

(86) PCT No.: PCT/EP2020/082874
§ 371 (c)(1),
(2) Date: May 20, 2022

(87) PCT Pub. No.: WO2021/099565
PCT Pub. Date: May 27, 2021

(65) Prior Publication Data

US 2022/0411998 A1 Dec. 29, 2022

(30) Foreign Application Priority Data

Nov. 22, 2019 (IT) ..... 102019000021930

(51) Int. Cl.
*D06N 3/00* (2006.01)
*D06N 3/02* (2006.01)
*D06N 3/14* (2006.01)

(52) U.S. Cl.
CPC ..... *D06N 3/0061* (2013.01); *D06N 3/14* (2013.01)

(58) Field of Classification Search
CPC ..... D06N 3/00; D06N 3/0061; D06N 3/14
See application file for complete search history.

(56) References Cited

U.S. PATENT DOCUMENTS

| | | | | |
|---|---|---|---|---|
| 9,771,435 | B2 * | 9/2017 | Santanocito | D21C 3/003 |
| 2018/0334773 | A1 | 11/2018 | Kang et al. | |
| 2021/0189642 | A1 * | 6/2021 | Parth | D06M 15/05 |
| 2022/0411998 | A1 * | 12/2022 | Santanocito | D06N 3/0061 |

FOREIGN PATENT DOCUMENTS

WO WO-2019076999 A1 * 4/2019 ..... C09D 101/02

OTHER PUBLICATIONS

ISR in PCT/EP2020/082874 issued on Dec. 11, 2020.

* cited by examiner

*Primary Examiner* — Karuna P Reddy
(74) *Attorney, Agent, or Firm* — Rivkin Radler LLP

(57) ABSTRACT

The present invention is directed to a synthetic leather preparation, said process includes the following steps: a. to extract a powder from a vegetal source having a volumetric average diameter particles lower than 40 μm, humidity content lower than 10% in weight, lignin content higher than 30% in weight on the dry residue, and fiber NDF content higher to 85% in weight measured on dry residue; b. to mix the powder obtained as from the step a) with polyurethane in relative quantities comprised between 15:85 and 85:15; c. to spread step b) mix on a vegetal origin support in the presence of a glue. The invention is also directed to the synthetic leather obtained from the above-described method.

7 Claims, 3 Drawing Sheets

SYNTHETIC LEATHER OF VEGETABLE ORIGIN

FIELD OF INVENTION

The present invention relates to a synthetic leather or artificial leather of vegetal origin and to its preparation process, especially it relates to a synthetic leather comprising a fraction derived from citrus-fruit into the superficial layer.

BACKGROUND OF THE INVENTION

Every year, nearly 12 million tons of agro-industrial waste are produced in Italy. Amongst these agro-industrial wastes, those derived from citrus fruit processes represent nearly one million tons. All these waste materials represent an extra cost for industries, which must get rid of the by-products according to current regulations. Thus, the process of the present invention supplies a suitable solution to capitalize the entire raw material while reducing the waste disposal.

The residue of citrus fruit squeezing represents the row material for the extraction of several ingredients. For example, WO 2015/018711 discloses the extraction of cellulose from the citrus pulp for textile fibres production.

The fashion industry is one of the most profitable and, at the same time, one of the most pollutant industries. According to the report "A new textile economy Redesigning fashion future" 2018 published by Ellen McArthur Foundation, the textile industry moves a business of 1,3 trillion dollars each year and with a supply chain employing more than 300 millions people around the world, releases about 1,2 billion of tons of $CO_2$ each year, pouring out 500,00 tons of microfibres into the oceans and consuming enormous amounts of not-renewable resources and water.

Among fashion industries, one of the more polluting is the leather industry, with a business of more than 100 billion dollars a year. This because tanning animal's leathers requires nearly 130 different chemical substances, including cyanide and chrome, which are highly dangerous for human's health and cause problems of disposal.

These problems and the cost of natural leathers, increased over the years the request of artificial leathers or synthetic leathers wherein the superficial layer is obtained by polymers such as polyurethanes or PVC which imitates the superficial effect of natural leather. Global demand of artificial leathers overcame 15,780 million meters in 2015 and it is foreseen a growth at a rate of 10% in the coming years.

In recent years, the increased awareness about the importance of environmental balance and the respect of natural resources, has led to the substitution of polyurethane and PVC by materials of natural origin. US2018/334773 discloses the use of a bio-urethane on a base layer of microfiber for the production of synthetic leather. WO2019/076999 discloses a synthetic leather whose superficial layer comprises apple fibers.

Nevertheless, the need still exists of new synthetic leathers of vegetal origin.

SUMMARY OF THE INVENTION

The present invention is directed to the production of vegetal origin synthetic leather by the use of a fraction of a vegetal source having high lignin content, such as Citrus pulp, *Sulla coronaria* (*Hedysarum coronarium* L) and peels of prickly pear.

Particularly, the invention is directed to a synthetic or artificial leather preparation process, said process including the following steps: a) extracting a powder from a vegetal source having an average volumetric diameter lower than 40 μm, humidity content lower than 10 wt %, lignin content higher than 30 wt % based on the dry residue, and NDF fiber content higher than 85 wt %, always based on the dry residue; b) blending the powder obtained in step a) with polyurethane in a weight ratio comprised between 15:85 and 85:15; c) spreading the mixture of step b) on a vegetal origin support together with a bonding agent or glue.

Besides, the invention is directed to an artificial leather consisting of two layers: a first layer made by a fiber obtained from renewable raw materials which layer is the support of the artificial leather; an upper layer having tactile characteristics similar to real leather and made by a mixture comprising: from 15 to 85 wt % of a vegetal fraction containing fibers in an amount of at least 85 wt % based on the dry fraction, of which at least 30 wt % consists of lignin; polyurethane in an amount from 15 to 85 wt %, and a bonding agent in an amount of from 0.5% to 5 wt %, wherein the sum of the three components is equal to 100.

DETAILED DESCRIPTION OF THE INVENTION

Figure 1:
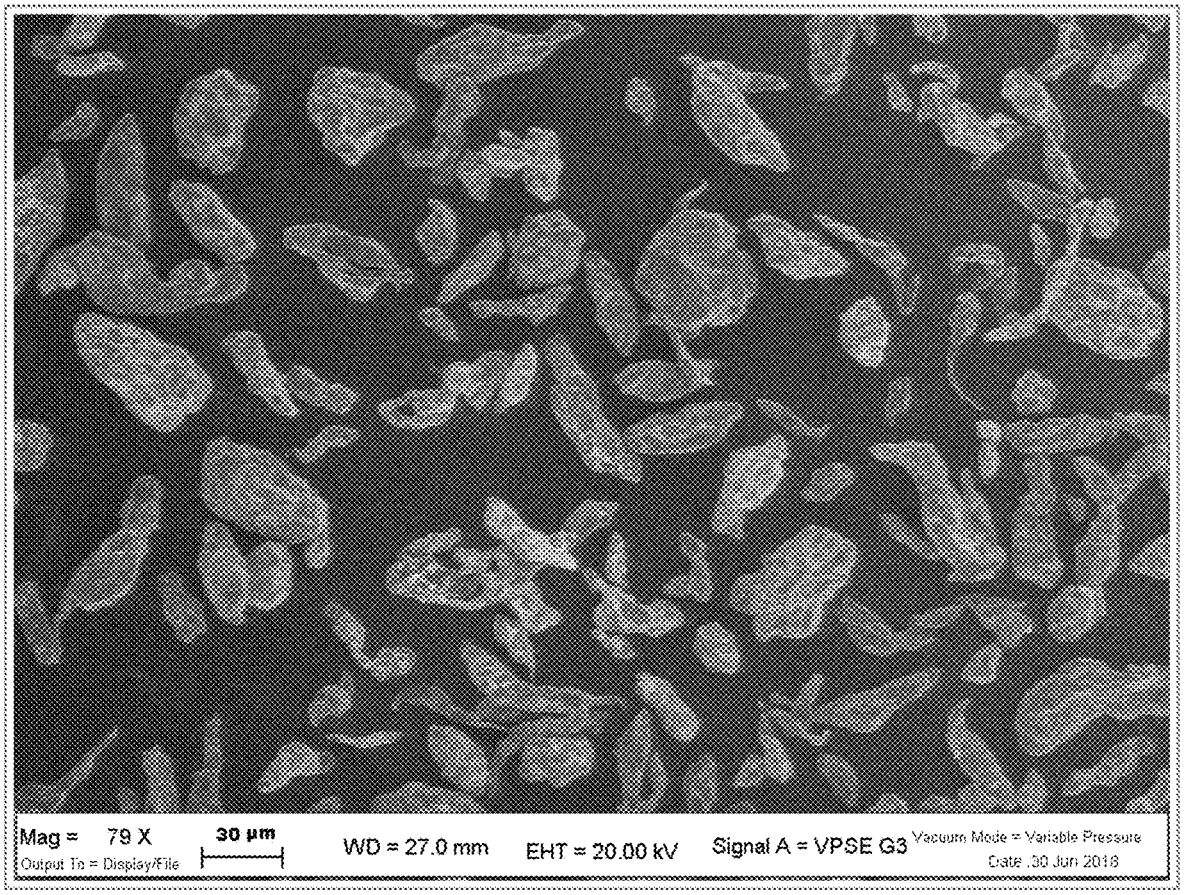
FIG. 1 shows the in electronic microscopy scan of a high lignin cellulose powder.
Figure 2:
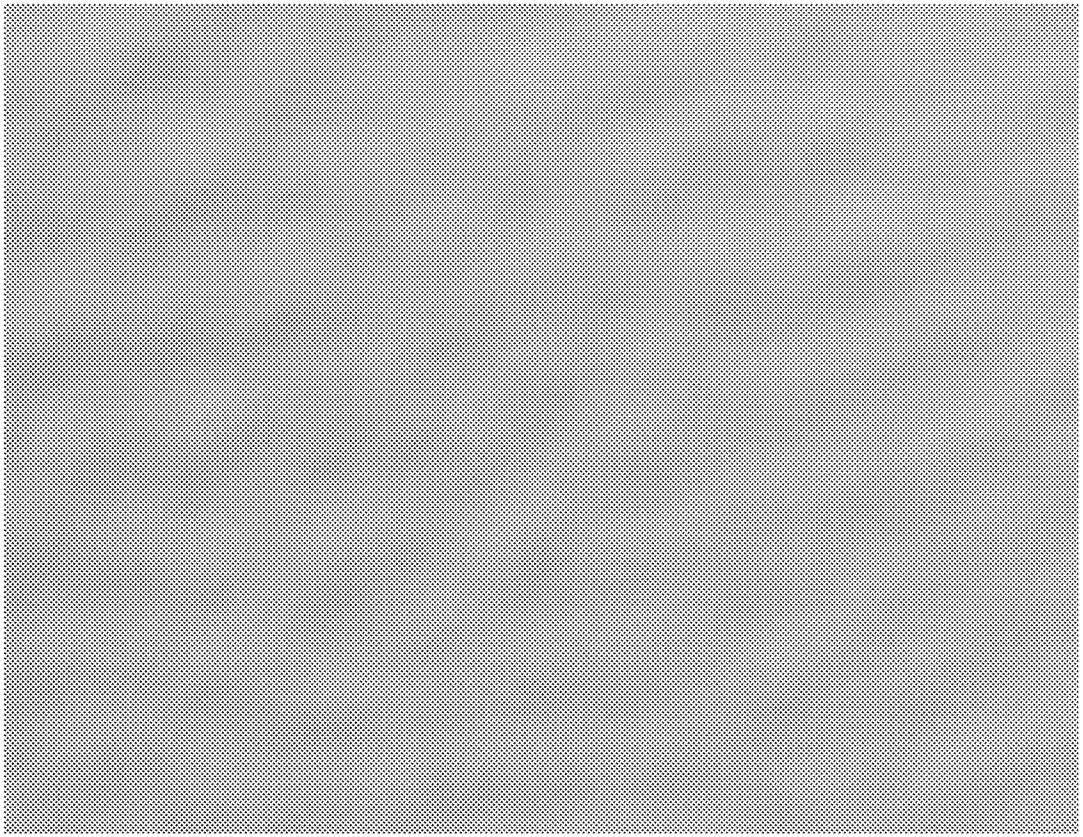
FIG. 2 shows a laboratory sample (swatch) of vegetal leather with a layer comprising 20 wt % powder and 80 wt % polyurethane.
Figure 3:
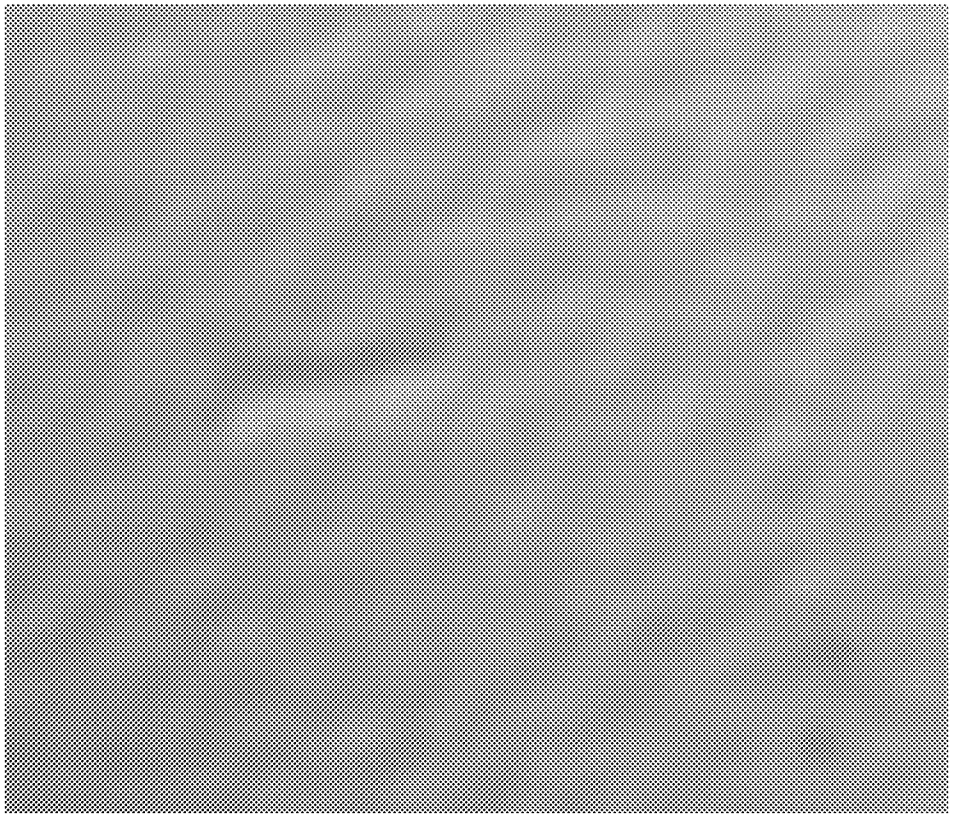
FIG. 3 shows a laboratory sample (swatch) of vegetal leather with layer comprising 50 wt % powder and 50 wt % polyurethane.

The invention is directed to a preparation process of synthetic leather, said process comprising the following steps: extracting from a vegetal source a powder having a volumetric diameter of particles lower than 40 μm, preferably lower or equal to 30 μm, humidity content lower than 10 wt %, content of lignin higher than 30 wt % based on the dry residue, and NDF fiber content higher than 85 wt %, always based on the dry residue; blending the powder obtained in the step a) with polyurethane in a weight ratio comprised between 15:85 and 85:15, preferably between 20:80 and 80:20; spreading the mix of step b) and bonding agent on a vegetal origin support.

The humidity content of the powder used in step a) is very important to reach the desired result. Thus, humidity has to be lower than 10 wt %, preferably lower than 8 wt %, even more preferably lower than 7 wt %.

The bonding agent or glue used in step c) can be one of the bonding agents used in the state of the art for the preparation of synthetic leathers. Nevertheless, the invention is preferably directed to a synthetic leather obtained from renewable raw materials. For this reason, it is preferred the use of a renewable glue, such as polylactic acid and/or cellulose acetate, which can be 100% obtained from renewable raw materials. In a preferred embodiment, the cellulose acetate used as a glue can be obtained as well from a vegetal source such as citrus peels.

The artificial leather obtained by the above-mentioned process consists of at least two layers: a first layer made by a fiber preferably obtained by a renewable raw material which constitutes the support of the artificial leather; an upper layer having tactile characteristics similar to the real leather and made by a mix comprising: from 15 to 85% in weight of a fraction of vegetal origin and containing at least 85 wt % of fiber, based on the dry residue, of which at least 30% consists of lignin; from 15 to 85% in weight of a polyurethane, and a glue in an amount comprised between 0.5% and 5 wt %, where the sum of three percentages is equal to 100.

In order to obtain a fraction suitable for synthetic leather, various vegetal raw material can be used, such as citrus pulp, *Sulla coronaria* and peels of prickly pear. When using citrus pulp, the starting raw material can be of different types. For example, it is possible to start from the residue obtained after citrus squeezing, i.e. citrus pulp as it is. The citrus pulp is an inhomogeneous matrix mainly containing water (over 90%), peels (albedo and flavedo), albedo, endocarp and, on a high lower measure, seeds and leaves.

The first problem in the pulp treatment is the excessive presence of water, which complicates both use and transportation. Generally, the pulp is dried by warm air streams, which allow to obtain a dehydrated and ready to use product. Nevertheless, the dried pulp is not easy to process in order to obtain the high lignin and cellulose raw material valuable for the present invention. A more effective method is dehydration of pulp by extraction with water or a suitable solvent. The solvent needs to be soluble in water and it is preferably an alcohol. Even more preferably said solvent is selected between methanol and ethanol. Alcohol is added to the pulp and the suspension is maintained under stirring for a period comprised between 5 minutes and 1 hour. The suspension is then filtered and the obtained solid is newly suspended in methanol preferably two more times. At the end, the solid is dried, e.g. by warming it at 50° C. under vacuum. The so obtained solid represents less than 10% of original pulp weight. This powder, before being further treated, is preferably sieved to eliminate still present pieces of peels.

The methanol which is present in the extracted mix can be recovered by distillation. The residue shall then consist of flavones and oligosaccharides. Another fraction of less polar flavones is recovered by extracting the dry residue obtained with methanol treatments by using an organic solvent such as ethyl acetate. The ethyl acetate obtained from extraction is yellow, while the residue powder is white. This white powder consisting of cellulose and lignin, having volumetric average diameter of particles lower than 40 μm, preferably lower or equal to 30 μm, humidity content lower than 10 wt %, content of lignin higher than 30 wt % based on the dry residue, and content of NDF fiber higher than 85 wt %, it is one of the ingredients, together with polyurethane and glue, for the preparation of the upper layer of the artificial leather. By reacting this powder with acetic anhydride, cellulose diacetate is obtained, which can be used as a glue in the artificial leather preparation. Preferably the acid is an inorganic strong acid, e.g. sulfuric acid. Once the reaction comes to an end, the cellulose diacetate is isolated.

Another raw material which can be used within the purpose of this invention is depectinized citrus pulp, that is pulp which already underwent pectine extraction. The pulp is subjected to a process with bases and oxidants at room temperature for 6-24 hours. At the end, the suspension is filtered, pressed, subjected to at least one wash and pressed again. The so obtained powder is resuspended in acetic acid in presence of the oxidant compound and brought at a temperature of 50-70° C. while mixing until a suspension is obtained. Said suspension is let under stirring for a period comprised between 6 and 24 hours, at the end of which it is filtered and acidified. The so obtained powder is preferably acetylated as in the previous case.

Alternatively, it is possible to start from a product currently used as animal food, that is orange peels dehydrated using calcium oxide. Treatment of this raw material is similar to the one used for depectinized pulp.

The product obtained from above mentioned processes, that is a powder containing at least 85% on the vegetal fiber dry residue and at least 30% in weight on the lignin dry residue, is used as a component on the synthetic leather preparation according to the invention.

The synthetic leather according to the invention is prepared following a conventional method. Preferably, a mix comprising vegetal (e.g. citrus fruit) powder, a synthetic polymer such as polyurethane, and a solvent suitable to form a homogeneous dispersion of the two components is spread.

The dimension of vegetal derived particles is essential to give the best tactile properties to the artificial leather. In fact, a coarse-grain powder produces an artificial leather which is not enough smooth to the touch. Thus, it has been found that an average particles size comprised between 1 and 500 nm, preferably between 5 and 250 nm, even more preferably between 10 and 50 nm produces the best touch effect of the artificial leather according to the present invention.

Experimental Part

Preparation of the Cellulose Powder High in Lignin 100 g of pulp were added to 100 ml of MeOH and mixed for about 15 minutes. The solution was then filtered under vacuum, through a pre-packed Gooch filter (or, alternatively, through metallic nets of chromatographic type) until the most of the solvent was eliminated and the solid recovered. This process was repeated three times until a solid "soaked" of methanol is obtained, which solid was dried under vacuum at a temperature of 50° C., until a fine powder was obtained. A rapid drying is crucial: when left to the open air the pulp tends to excessively harden and limit any kind of further modification. The mass of the dry compound was 6.2 grams. This represents a mass reduction of about 94%.

Flavone Recovering

Methanol obtained by filtration as mentioned above, is rich in flavones. MeOH can be recovered by a simple distillation. Inside the distillation flask remains water containing flavones and oligosaccharides extracted from the pulp by the organic solvent. One more flavone fraction is recovered as described below.

Citrus fruit powder obtained from the above-mentioned drying process was separated from peels, still present, by mechanical sifting. Peels and seeds can be collected and used as animal food. Alternatively, it is possible to crumble them through a mechanical homogenizer and treat them with peracetic acid in order to obtain a thin raw white foil. Citrus fruit powder underwent a second ethyl acetate extraction for 4 hours, in order to remove most non-polar flavones still present, as it was noticeable from its bright yellow color. The final product was a white powder.

Preparation of Cellulose Diacetate

To the white powder, 0.1 ml of concentrated sulfuric acid were added; then the mixture was left under stirring for one hour at 40° C. Thereafter, 20 ml of acetic anhydride were added, and the temperature raised to 50° C. After about 3 hours, a mixture of triacetate and diacetate was obtained. The mixture was precipitated in 200 ml water (alternatively the use of methanol is also possible) and filtered. The white powder (3 g of weight), after being dried under vacuum at 55° C., was left in 60 ml of acetic acid 90% under stirring for 12 hours. The final powder can be dissolved in acetone or dichloromethane/methanol to obtain (after centrifugation) respectively diacetate and triacetate.

Example 1

500 ml of bio-polyurethane from renewable source were set under intense stirring by using a laboratory homogenizer (ultra-turrax); 200 g of white powder as obtained above (88% NDF, 32% lignin ADL, 30 μm average diameter) were progressively added until complete dispersion to obtain a dense and homogeneous liquid.

Stabilizers and preservatives are added to the obtained mix as for the standard industrial protocol known in the state of the art and bio-polyurethane from renewable source was added until reaching 1 Kg of total mass.

The stabilized mix is manually spread on a pre-formed paper support so to obtain a superficial pattern similar to leather. A biological cotton canvas is laid on the fresh coating. The whole was then placed in the oven at 135° C. for 15 minutes.

The swatch was removed from the oven, left to cool, and the pre-formed paper support is ripped out. The obtained vegetal leather is composed for 97% of raw materials from renewable source (40% cotton, 12% citrus fruit lignocellulose, 45% bio-polyurethane).

Example 2

500 ml of bio-polyurethane from renewable source were set under intense stirring by using a laboratory homogenizer (ultra-turrax); 400 g of white powder as obtained above (88% NDF, 32% lignin ADL, 30 μm average diameter) were progressively added until complete dispersion as to obtain a dense and homogeneous liquid.

Preservatives and stabilizers were added to the obtained mix as for the standard industrial protocol known in the state of the art and bio-polyurethane from renewable source were added until reaching 1 Kg of total mass.

The stabilized mix is manually spread on a pre-formed paper support so to obtain a superficial pattern similar to leather. A canvas of cellulose acetate obtained from citrus was then laid on the fresh coating. The whole was then placed in the oven at 135° C. for 15 minutes.

The swatch was removed from the oven, left to cool, and the pre-formed paper support was ripped out. The obtained vegetal leather is composed for 97% of raw materials from renewable source (54% citrus fruit lignocellulose, 43% bio-polyurethane).

The invention claimed is:

1. A process for the preparation of artificial leather, which process comprises the following steps:

a. extracting from citrus peels, a powder having average particle size by volume lower than 40 μm, humidity content lower than 10 wt %, lignin content higher than 30 wt % based on the dry residue, and NDF fibre content higher than 85 wt % based on the dry residue;

b. blending the powder obtained in step a) with polyurethane in a relative amount comprised between 15:85 and 85:15; and c. spreading the blend of step b) onto a support of vegetal origin in the presence of a bonding agent.

2. The process of claim 1, wherein in step a) the powder has a humidity content lower than 8 wt %.

3. The process according to claim 1, wherein in step c) the support of vegetal origin comprises opuntia fibres.

4. The process according to claim 3, wherein the support of vegetal origin further comprises hemp fibres.

5. An artificial leather comprising two layers:

a. a first layer comprising fibers obtained from renewable raw materials of vegetal origin, which layer represents a support of the artificial leather;

b. an upper layer having tactile characteristics similar to leather and formed by a mixture comprising:

i. from 15 to 85 wt % of a fraction extracted from citrus peel and comprising at least 85 wt % of NDF fibre, at least 30% of which is lignin;

ii. from 15 to 85 wt % of a polyurethane; and iii. from 0.5 to 5 wt % of a bonding agent.

6. The artificial leather of claim 5, wherein said fibre is derived from opuntia.

7. The artificial leather of claim 6, wherein said fibre further comprises hemp fibres.

* * * * *